United States Patent [19]

Kaminaka et al.

[11] Patent Number: 4,523,530

[45] Date of Patent: Jun. 18, 1985

[54] POWDERY COAL BURNER

[75] Inventors: Motofumi Kaminaka, Wakayama; Hiroyuki Takashima, Ibaragi; Katsuhiko Kaburagi, Wakayama, all of Japan

[73] Assignee: Sumitomo Metal Industries, Ltd., Osaka, Japan

[21] Appl. No.: 468,317

[22] Filed: Feb. 22, 1983

[30] Foreign Application Priority Data

Feb. 26, 1982 [JP] Japan ..... 57-28169

[51] Int. Cl.[3] ..... F23D 1/02

[52] U.S. Cl. ..... 110/264; 110/265; 431/182; 431/188; 431/284; 239/403; 239/424

[58] Field of Search ..... 431/160, 174, 182, 183, 431/184, 187, 188, 284; 110/263, 264, 265; 239/399, 400, 403, 405, 406, 422, 423, 424

[56] References Cited

U.S. PATENT DOCUMENTS

| | | | |
|---|---|---|---|
| 3,147,795 | 9/1964 | Livingston et al. | 431/284 |
| 3,894,834 | 7/1975 | Estes | 431/174 |
| 4,147,116 | 4/1979 | Graybill | 110/263 |
| 4,206,712 | 6/1980 | Vatsky | 110/264 |
| 4,333,405 | 6/1982 | Michelfelder et al. | 110/264 |
| 4,367,686 | 1/1983 | Adrian | 110/263 X |
| 4,373,900 | 2/1983 | Eckelmann | 431/182 |
| 4,394,120 | 7/1983 | Golovanov et al. | 431/284 |
| 4,422,391 | 12/1983 | Izuha et al. | 110/263 X |

FOREIGN PATENT DOCUMENTS

| | | | |
|---|---|---|---|
| 2043871 | 10/1980 | United Kingdom | 431/183 |
| 298796 | 12/1971 | U.S.S.R. | 431/187 |

*Primary Examiner*—Margaret A. Focarino

*Attorney, Agent, or Firm*—Burns, Doane, Swecker & Mathis

[57] ABSTRACT

A powdery coal burner is disclosed, which comprises a burner nozzle having an opening at the end of the burner body, through which a combustion-assisting gaseous medium is injected into a combustion area, means of providing a swirling motion to said combustion-assisting gaseous medium which is injected through said burner nozzle to said combustion area in a swirled state, an injection nozzle having an opening surrounding said burner nozzle opening, through which coal is injected toward said combustion area, and a primary air outlet nozzle having an opening surrounding said opening of said injection nozzle for the powdery coal, through which a primary combustion air is forwardly injected.

10 Claims, 3 Drawing Figures

POWDERY COAL BURNER

BACKGROUND OF THE INVENTION

The present invention relates to a burner for a so-called "powdery coal" or "powdered coal" which is provided by finely pulverizing coal (hereunder referred to as "powdery coal burner").

Recently, since oil prices have been sharply increasing, coal fuel has been re-emerging as a source of energy in place of oil fuel.

In order to increase the efficiency of the combustion of coal, the coal should be burned in a powdery form, i.e. powdered form. However, the usage of powdery coal is generally limited to large capacity burners such as found in power plant boilers, cement-manufacturing kilns and the like. This is due to fact that the combustion rate of coal is lower than that of gaseous or liquid fuels, and that the flame characteristics of coal are quite different from those of the gaseous or liquid fuels. Thus, powdery coal has almost never been used in small capacity burners for the following reasons:

(i) The total amount of heat accumulated in the combustion field of small capacity burners is much smaller than that of large capacity burners, making it impossible to maintain a continuous combustion of coal in small capacity burners even when utilizing powdery coal. This is because of the fact that powdery coal is characterized by a higher catch-fire point and less flame stability in comparison with gaseous or liquid fuels.

(ii) The combustion rate of powdery coal is very slow, making it difficult to produce sufficient combustion within a limited area. In addition, a combustion flame is sometimes formed in an area remote from the front end of the burner. Therefore, the formation of a large amount of partly combusted coal particles and other fuels (hereunder referred to as "uncombusted matters") is inevitable in small capacity burners, which essentially require not only the achievement of a high temperature, intensive combustion within a limited area, but also the formation of a short flame.

Several methods have been known to increase the combustion rate of fuels. One of them is applying a swirling motion to the combustion air and/or the fuel itself. When such a conventional method is applied to powdery coal burners, though it is possible to shorten the flame length, the coal powder to which the swirling motion has been applied to flows in radial directions which excessively extends the combusion flame area, sometimes resulting in precipitation of fused coal onto a wall area ajacent to the burner nozzle under high temperature conditions. This is called "clinkering" and sometimes obstructs the operation of the burner. If the furnace temperature is relatively low, coarse coal particles will be blown from a high temperature area around the axis of the burner to a low temperature area in the periphery of the combustion flame, resulting in a relatively large amount of uncombusted matters.

SUMMARY OF THE INVENTION

A major object of the present invention is to provide a powdery coal burner in which the flame profile can be controlled as easily as in the case of liquid fuel burners.

Another object of the present invention is to provide a powdery coal burner in which a satisfactory continuous combustion can successfully be maintained regardless of the size of the burner combustion area.

In summary, the present invention resides in a powdery coal burner which comprises a burner nozzle having an opening at the end of the burner body, through which a combustion-assisting or combustible gaseous medium (hereunder collectively referred to as "combustion-assisting gaseous medium") is injected into a combustion area, means of providing a swirling motion to said combustion-assisting gaseous medium which is injected through said burner nozzle to said combustion area in a swirled state, and an injection nozzle having an opening surrounding said burner nozzle opening, through which powdered coal is injected toward said combustion area. An annular nozzle for a primary combustion air is provided surrounding said injection nozzle for powdered coal. Means for producing a swirling motion to said primary combustion air is also provided within said annular nozzle.

The powdery coal burner of the present invention may further comprise a secondary air outlet nozzle having an opening surrounding said opening of the above primary combustion air outlet, through which a secondary combustion air is forwardly injected.

The burner nozzle, powdery coal injection nozzle and primary combustion air nozzle are provided concentrically with each other. In a preferred embodiment of the present invention the above mentioned three nozzles are converged concentrically with each other and their open ends are positioned on the same plane facing a divergent frustconical opening.

In another preferred embodiment of the present invention, the secondary air outlet nozzle is provided surrounding said divergent frust-conical opening. The open end of said secondary air outlet nozzle is positioned downstream with respect to the open ends of said burner nozzle, powdery coal injection nozzle and primary combustion air nozzle. The annular passage of said secondary combustion air nozzle may preferably be fabricated in such a manner that its width varies in the circumferential direction in order to bring about changes in air-flow pressure in the circumferential direction.

DETAILED DESCRIPTION OF PREFERRED EMBODIMENTS OF THE PRESENT INVENTION

Figure 1:
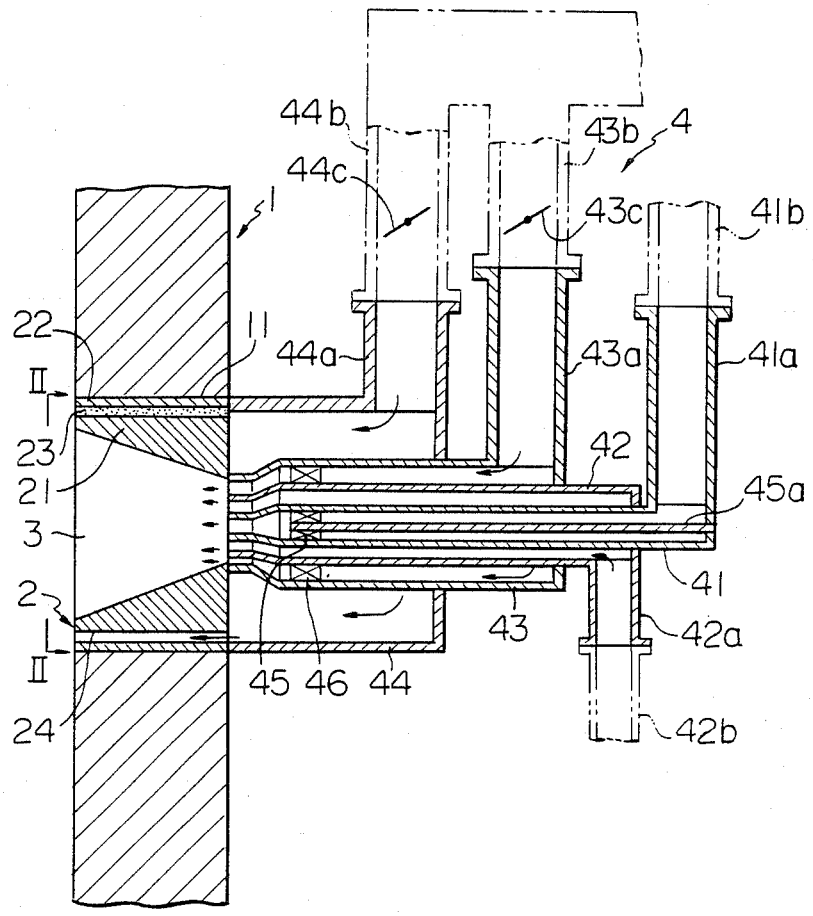
FIG. 1 is a longitudinal sectional view of a powdery coal burner according to the present invention.

The present invention will now be described in detail with reference to the drawings showing an embodiment of the powdery coal burner of the present invention. In the drawings, similar portions are represented by similar numerals.

In FIG. 1, a flame introducing opening 3 is formed in a furnace wall 1 of a combustion furnace. The opening 3 is surrounded by a burner tile 2 made of a fire-proof material. The burner tile 2 comprises a cylindrical member 21 having a frust-conical through-hole, and a concentric ring 22 arranged radially outwardly with respect to the cylindrical member 21. The members 21 and 22 have a length equal to the thickness of the furnace wall 1. The frusto-conical through-hole in the cylindrical member 21 has a diameter gradually increasing from the outer surface of the furnace wall to the inner surface thereof (from the right hand side to the left hand side facing FIG. 1). This frust-conical through-hole constitutes the flame introducing opening 3. The ring 22 has an outer diameter equal to an inner diameter of a bore 11 in the furnace wall 1 and an inner diameter slightly larger than an outer diameter of the cylindrical member 21. The ring 22 is fitted in the bore 11 in the furnace wall, while the cylindrical member 21 is mounted within the ring 22 substantially concentrically therewith.

A burner body 4 arranged adjacent to the flame introducing opening 3 comprises a central injection conduit 41 for introducing a gaseous fuel, an intermediate conduit 42 concentrically surrounding the central injection conduit 41, which injects powdery coal together with a carrier gas such as air and the like, a primary air-introducing conduit 43, and a secondary air-introducing conduit 44 arranged concentrically with each other. Between each conduit a predetermined clearance is provided, thus making a fourfold wall cylinder. The longitudinal length of injection conduit 41 is longer than that of injection conduit 42, which in turn is longer than that of the conduit 43. The outermost conduit 44 has the shortest length. Each of the conduits 41, 42, 43 has an opening facing toward the flame introducing opening 3, each opening forming a nozzle, said nozzles being positioned in the same plane and being converged concentrically with each other. Thus, each nozzle end communicates with the opening 3. The front end of the conduit 44 is arranged in such a way that the secondary air-introducing conduit 44 communicates with the secondary air injection passage 24 provided between the cylindrical member 21 and the ring 22. The opposite ends of each of said conduits 41, 42, 43 and 44 are closed and communicate with connecting conduits 41*a*, 42*a*, 43*a* and 44*a*, respectively, which are in turn connected with a gaseous fuel supply line 41*b*, a powdery coal supply line 42*b* and a primary and secondary air supply lines 43*b*, 44*b*, respectively. These supply members are indicated by phantom lines in FIG. 1. The powdery coal supply line 42*b* is also connected to a powdery coal hopper (not shown) and a carrier gas tank or blower (not shown). The air supply lines 43*b*, 44*b* are also connected to a blower (not shown). The flow rate of the gaseous fuel is regulated with a flow control valve (not shown). The flow rate of the combustion air in the primary and secondary supply lines 43*b* and 44*b* are controlled with dampers 43*c* and 44*c*, respectively.

In order to give a swirling motion to a fluid, rotating blades 45, 46 are respectively provided along the gaseous fuel supply conduit 41 and the primary combustion air supply conduit 43, near the nozzles thereof. The swirling blade 45 is fixed to the tip of an arm 45*a* which extends from the opposite, closed end of the conduit 41. On the other hand, the rotating blade 46 is provided within the area of the primary conduit 43. These blades 45, 46 give a swirling motion to the gaseous fuel and the primary air, respectively, thereby causing the fuel and air inputted into the flame-introducing opening 3 to be injected in a swirled state. The structures of the rotating blades 45, 46 are not restricted to any specific one, and rotating blades of any other shapes may be utilized, as long as the gaseous fuel as well as the primary combustion air may be injected to the opening 3 in a swirled state.

Figure 2:
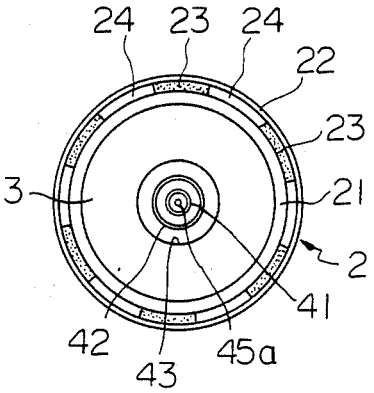
FIG. 2 is an end view taken along the line II—II of FIG. 1.

As is clearly shown in FIG. 2, a plurality of spacers or fillers 23 are arranged between the ring 22 and the cylindrical member 21, said spacers being spaced apart each other in the circumferential direction. Each spacer 23 has a length equal to that of the cylindrical member and the ring, and a predetermined circumferential width. Slit-shaped air passages 24 are formed between the spacers 23. The air passages 24 communicate with the secondary air-introducing conduit 44 which will be explained hereinafter. Thus, the air passages 24 are positioned around the flame introducing opening 3, said air passages being equidistant from each other along the circumferential direction thereof (see FIG. 2). Of course, in place of the above-mentioned arrangement, the spacers may be interposed between the ring 22 and the member 21 in such a manner as to reduce the width of the clearance between the members 21 and 22. In this case, the air passage is formed as a continuous annular passage having reduced width portions in a plurality of areas in the circumferential direction. Thus, a spacer or spacers are provided in the annular clearance between the members 21 and 22 so as to bring about changes in air-flow pressure in the circumferential direction.

Figure 3:
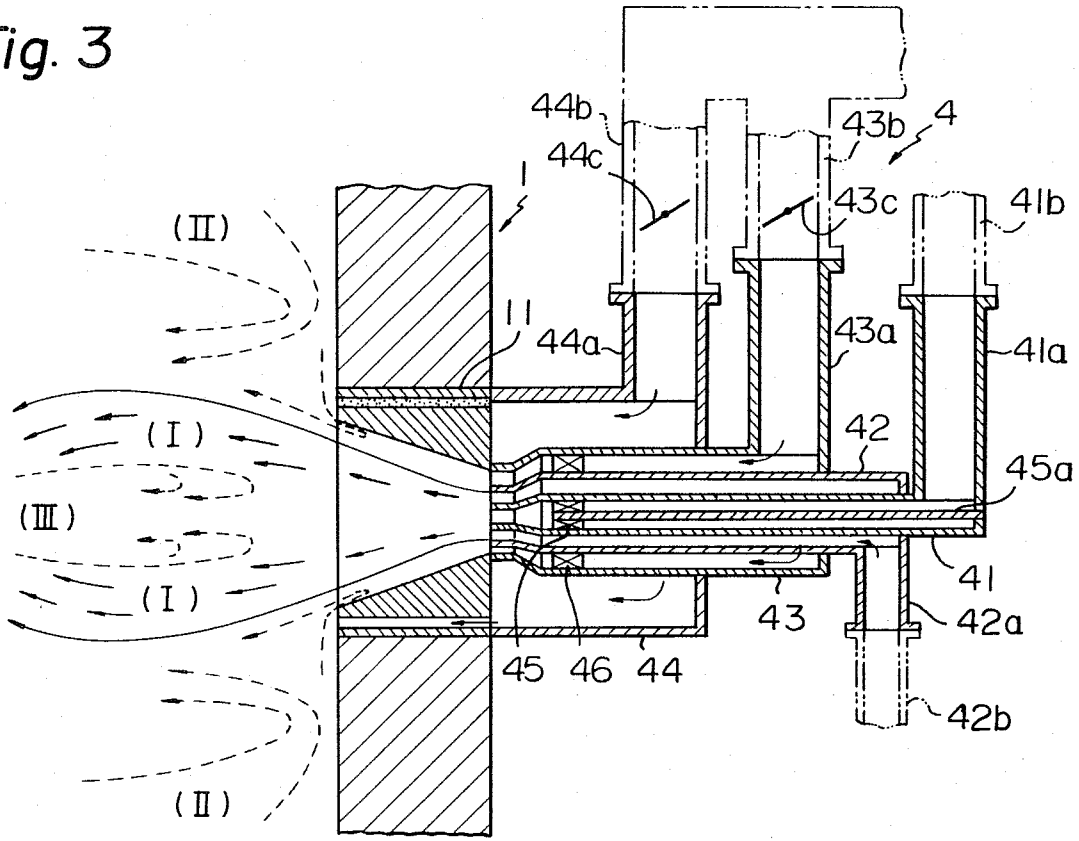
FIG. 3 is a schematic view of a combustion area in which flows each of powdery coal and combustion gas are shown by arrows.

With the above arrangements of the air passages or passage, that is to say, by arranging a plurality of the air passages around the flame introducing opening 3 concentrically therewith or by providing an annular air passage having a circumferentially variable clearance, as shown in FIG. 3, the secondary air injected from the above air passage or passages creates a predetermined pressure difference therein in its circumferential direction, thereby causing hot gas in the combustion furnace to flow backward through areas corresponding to the portions where the clearance between the cylindrical member 21 and the ring 22 is filled up with the spacers or where the clearance is reduced by the presence of the spacer, causing self-circulation of the combustion gas, thus facilitating a thermal decomposition and gasification of the powdery coal injected. See Zone (II) in FIG. 3. In FIG. 3 the flows of the combustion-assisting gaseous medium and powdery coal are shown by full-line arrows, and the flows of the combustion gas are shown by broken line arrows.

Thus, according to the powdery coal burner of the present invention, as is clearly shown in FIG. 3, a swirled stream of gaseous fuel is injected through an injection nozzle 41, powdery coal together with a carrier gas, such as air, are injected through an outer injection nozzle 42, and a swirled stream of primary combustion air is also injected through an outer injection nozzle 43 which is provided surrounding said outer injection nozzle 42. The swirled flow of the gaseous fuel, which is injected through the injection nozzle 41, expands in the radial direction passing through powdery coal zone which is injected through the injection nozzle 42, causing, not only the distribution of the powdery coal in the radial direction, but also the combustion of the powdery coal.

In other words, the powdery coal injected through the injection nozzle 42 is combusted with a swirling and expanding flow of gaseous fuel thereby expanding the combustion flame in the radial direction. Thus, the diameter of the combustion flame increases, and the longitudinal length of the combustion flame decreases, accordingly. See Zone (I) in FIG. 3. This also causes the combustion gas to flow backward to the central area of the combustion flame (see Zone (III) in FIG. 3).

The finer the coal particles, the higher the combustion rate. Fine coal particles are combusted first while coarse coal particles expand forwardly and slightly in the radial direction across the combustion zone of the fine coal particles because of their high inertia force. During the passing of the coarse coal particles through a high temperature combustion zone, their gasification is accelerated. The evolved gases are combusted within a restricted area defined by the swirling flow of the primary combustion air which is injected through the injection nozzle 43. Thus, even the combustion area for the coarse particles is also confined within a restricted area.

The secondary combustion air is injected toward an area surrounding the above mentioned combustion area, and prevent the combustion flame from excessively expanding, thereby cooling an area adjacent to the burner tile 2 and preventing ashes from fusing and depositing onto the burner tile 2. In addition, the provision of the annular air-passage having different cross-sectional areas in the circumferential direction, as already mentioned, creates a difference in pressure in the circumferential direction of the air flow. Consequently, due to a low pressure in the flow of the secondary combustion air, as in Zone (II) in FIG. 3, hot gases in the front end of the combustion flame flow backward to the peripheral area of the flame-introducing opening 3 to further accelerate the combustion of coal, thus preventing the formation of a large amount of uncombusted matter. A combustion with less evolution of NOx is also successfully attained.

The gas which is injected through the injection nozzle 41 is not restricted to a combustible gaseous fuel only, but other gases such as combustion-assisting gases including oxygen, oxygen-enriched air, air preheated to a temperature higher than the fire-catch point of the coal, etc., may be used in place of the gaseous fuel.

Furthermore, when the furnace temperature is high enough to fire the coal or when a large capacity burner is employed, combustion air or exhausted gas (in case the circulation system for the exhausted gas is employed) may be injected through the injection nozzle 41 in place of the gaseous fuel.

The following example is presented only for the purpose of illustrating the present invention, which is not restricted to the specific details therein set forth.

EXAMPLE

A combustion test carried out with the burner of the present invention shown in FIGS. 1 and 2 will be explained in comparison with that carried out using the conventional burner having a single nozzle structure. The combustion test was carried out under the following conditions:

1. Coal Analysis: See Table 1 below.
2. Coal Particle Size: −200 mesh 70% by weight
3. Supply: 30 kg/hr
4. Coal Carrier Gas Flow Rate: 50 $Nm^3/hr$
5. Furnace Dimensions: 1 m(width)×1 m(height)×3 m(length)
6. Primary Combustion Air Temperature: 18° C.
7. Secondary Combustion Air Temperature: 18° C.
8. Gaseous Fuel:Coke Oven Gas (4600 kcal/$Nm^3$) at a flow rate of 5 $Nm^3/hr$ The results obtained in the above combustion test are summarized in Table 2 below.

TABLE 1

| Industrial Analysis (% by weight) | | | | Elemental Analysis (% by weight) | | | | Calorific Value |
|---|---|---|---|---|---|---|---|---|
| Moisture | Ash | Volatiles | Fixed Carbon | C | H | N | S | (Kcal/kg) |
| 3.1 | 9.6 | 32.3 | 55.0 | 80.8 | 4.9 | 1.8 | 0.9 | 7739 |

TABLE 2

| | Air/Fuel ratio | NOx (ppm)* | Flame Length (m) |
|---|---|---|---|
| This Invention | 1.05 | 250 | 1 |
| Comparative | 1.2 | 730 | 3 |

Note:
*The amount of NOx was calculated by conversion assuming that 4% of $O_2$ is contained.

As is apparent from the data shown in Table 2, the conventional burner has to employ an air to fuel ratio not lower than 1.2 in order to avoid the formation of a large amount of uncombusted matters, which is usually found in the case where the ratio is lower than 1.2. NOx was formed in an amount of 730 ppm. On the other hand, the burner of the present invention can achieve a much better combustion, and substantially no uncombusted matters were formed n spite of the fact that the air to fuel ratio is as low as 1.05.

NOx was formed in an amount of 250 ppm, i.e. one-third of that obtained in the conventional burner.

Furthermore, the length of the combustion flame was 3 m for the conventional burner, the flame was less stable and extended away from the flame-introducing opening 3 in the direction of the opposite furnace wall. The flame was not so bright as an oil-fired flame, but was dark-red. It seemed that the whole combustion chamber was filled with coal dust. However, according to the present invention, the length of the combustion flame was as short as 1 m, and the diameter of the flame was a little larger than that of the diameter of burner tile 2. The resulting flame was as bright as that an oil-fired flame. The profile of the flame was the same as that an oil-fired flame (burner). What is more, the interior of the furnace was clearly visible from the outside, and there was not appreciable deposition of fused ash onto the burner tile 2 and the periphery of the flame-introducing opening 3.

As has been described, the present invention can provide a powdery coal burner, which can achieve a stable combustion of powdery coal, in which the flame length in the longitudinal direction can be controlled as efficiently as in the case of oil fuel burners. Therefore, the present invention can easily be applied to conventional oil fuel burners. In addition, a combustion with a low air-to-fuel ratio can successfully be continued with less NOx being formed.

It is believed that the present invention will make a great contribution to developments in the field of energy.

Although the present invention has been described with preferred embodiments it is to be understood that variations and modifications may be employed without departing from the concept of the present invention as defined in the following claims:

What is claimed is:

1. A powdery coal burner which comprises a burner nozzle having an opening at the end of the burner body for injecting a combustionassisting gaseous fuel medium into a combustion area, means for supplying a combustion-assisting gaseous fuel medium to said burner nozzle, means for providing a swirling motion to said combustion-assisting gaseous fuel medium which is injected through said burner nozzle to said combustion area in a swirled state, an injection nozzle having an opening surrounding said burner nozzle opening for injecting coal toward said combustion area, means for supplying coal to said injection nozzle, a primary air outlet nozzle for forwardly injecting primary combustion air, said primary air outlet nozzle having an opening surrounding said opening of said injection nozzle for the powdery coal, means for supplying primary combustion air to said primary air outlet nozzle, and means for providing a swirling motion to said primary combustion air.

2. The powdery coal burner defined in claim 1, in which said burner nozzle, powdery coal injection nozzle and primary combustion air nozzle are provided concentrically with each other and are converged concentrically with each other.

3. The powdery coal burner defined in claim 2, in which the open end of each of said burner nozzle, powdery coal injection nozzle and primary combustion air nozzle is positioned on the same plane facing a divergent frustoconical opening.

4. A powdery coal burner which comprises a burner nozzle having an opening at the end of the burner body for injecting a combustion-assisting gaseous fuel medium into a combustion area, means for supplying a combustion-assisting gaseous fuel medium to said burner nozzle, means for providing a swirling motion to said combustion-assisting gaseous fuel medium which is injected through said burner nozzle to said combustion area in a swirled state, an injection nozzle having an opening surrounding said burner nozzle opening for injecting coal toward said combustion area, means for supplying coal to said injection nozzle, and a primary air outlet nozzle for forwardly injecting primary combustion air, said primary air outlet nozzle having an opening surrounding said opening of said injection nozzle for the powdery coal, wherein said burner nozzle, powdery coal injection nozzle and primary combustion air nozzle are provided concentrically with each other, wherein the open end of each of said burner nozzle, powdery coal injection nozzle and primary combustion air nozzle is positioned on the same plane facing a divergent frustoconical opening, said powdery coal burner further comprises a secondary air outlet nozzle having an opening surrounding said opening of said primary combustion air outlet nozzle, through which a secondary combustion air is forwardly injected.

5. The powdery coal burner defined in claim 4, in which said secondary air outlet nozzle is provided surrounding said divergent frust-conical opening.

6. The powdery coal burner defined in claim 4, in which an open end of said secondary air outlet nozzle is positioned downstream with respect to the open ends of said burner nozzle, powdery coal injection nozzle and primary combustion air nozzle.

7. The powdery coal burner defined in claim 6, in which an annular conduit which constitutes said secondary air outlet nozzle has varying widths in the circumferential direction.

8. The powdery coal burner defined in claim 7, in which the width of said annular conduit is changed by providing a plurality of spacers spaced apart each other in the circumferential direction.

9. The powdery coal burner defined in claim 4, in which said burner nozzle, powdery coal injection nozzle and primary combustion air nozzle are converged concentrically with each other.

10. The powdery coal burner defined in claim 4, which further comprises means for providing a swirling motion to said primary combustion air.

* * * * *